US010697215B2

(12) United States Patent
Li

(10) Patent No.: US 10,697,215 B2
(45) **Date of Patent: *Jun. 30, 2020**

(54) TOOLBOX-LOCKING APPARATUUS

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 361 days.

This patent is subject to a terminal disclaimer.

(21) Appl. No.: 15/675,777

(22) Filed: Aug. 13, 2017

(65) Prior Publication Data

US 2019/0048631 A1 Feb. 14, 2019

(51) Int. Cl.

| | |
|---|---|
| ***E05C 19/12*** | (2006.01) |
| ***B25H 3/02*** | (2006.01) |
| ***B65D 43/22*** | (2006.01) |
| ***E05C 19/14*** | (2006.01) |

(52) U.S. Cl.

CPC ..... *E05C 19/12* (2013.01); *B25H 3/02* (2013.01); *B65D 43/22* (2013.01); *E05C 19/14* (2013.01)

(58) Field of Classification Search

CPC . E05C 19/12; E05C 3/12; E05C 3/122; E05C 3/124; B25H 3/02; B25H 3/00; B65D 43/22; B65D 43/18; B65D 43/16; B65D 43/166; B65D 25/28; B65D 25/2802; B65D 41/18; E05B 47/00; E05B 47/0012; E05B 65/46; E05B 65/463; F24C 15/00; F24C 15/02; F24C 15/022

USPC ..... 292/278

See application file for complete search history.

(56) References Cited

U.S. PATENT DOCUMENTS

| | | | | |
|---|---|---|---|---|
| 3,134,617 A * | 5/1964 | Slonneger | E05C 19/14 | 292/3 |
| 3,208,781 A * | 9/1965 | Appleberry | E05C 3/14 | 292/128 |
| 4,804,215 A * | 2/1989 | Bisbing | E05C 19/14 | 292/113 |
| 8,567,631 B2 * | 10/2013 | Brunner | B25H 3/02 | 220/326 |

* cited by examiner

*Primary Examiner* — Nathan Cumar

(57) ABSTRACT

A toolbox is provided with a locking apparatus including a buckle and a driving unit. The buckle includes a space. The driving unit is inserted in the space and includes a pivotal element and a torque spring. The pivotal element is pivotally connected to the buckle. The torque spring is supported on the pivotal element and adapted for biasing the pivotal element relative to the buckle. The pivotal element includes a rod, an axle extending coaxially from the rod, and two cams formed on the axle and separated from each other by a gap. The torque spring includes a helical section supported on the axle and kept in the gap between the cams.

5 Claims, 4 Drawing Sheets

TOOLBOX-LOCKING APPARATUUS

BACKGROUND OF INVENTION

1. Field of Invention

The present invention relates to a toolbox and, more particularly, to a toolbox-locking apparatus.

2. Related Prior Art

A typical toolbox includes two shells pivotally connected to each other. Each of the shells is used to carry various tools and tool bits. The toolbox includes at least one locking apparatus operable to keep the shells closed and the tools and tool bits in the toolbox.

A conventional locking apparatus includes a buckle formed on or connected to one of the shells and a buckle-engaging element formed on or connected to the other shell. The buckle can be engaged with the buckle-engaging element to keep the toolbox closed.

A locking apparatus further includes a torque spring arranged between the buckle and the corresponding shell. The torque spring is intended to automatically pivot the buckle further from the buckle-engaging element after the buckle is manually disengaged from the buckle-engaging element. However, the buckle is not always smooth disengaged from the buckle-engaging element. To smoothly disengage the buckle from the buckle-engaging element, a user often has to maneuver the buckle with one hand while pressing the shells tightly against each other with the other hand. The operation of the locking apparatus is hence inconvenient and buckle could be reengaged with the buckle-engaging element by mistake.

The present invention is therefore intended to obviate or at least alleviate the problems encountered in prior art.

SUMMARY OF INVENTION

It is the primary objective of the present invention to provide a toolbox with an efficient, effective and reliable locking apparatus.

To achieve the foregoing objective, the locking apparatus includes a buckle and a driving unit. The buckle includes a space. The driving unit is inserted in the space and includes a pivotal element and a torque spring. The pivotal element is pivotally connected to the buckle. The torque spring is supported on the pivotal element and adapted for biasing the pivotal element relative to the buckle. The pivotal element includes a rod, an axle extending coaxially from the rod, and two cams formed on the axle and separated from each other by a gap. The torque spring includes a helical section supported on the axle and kept in the gap between the cams.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
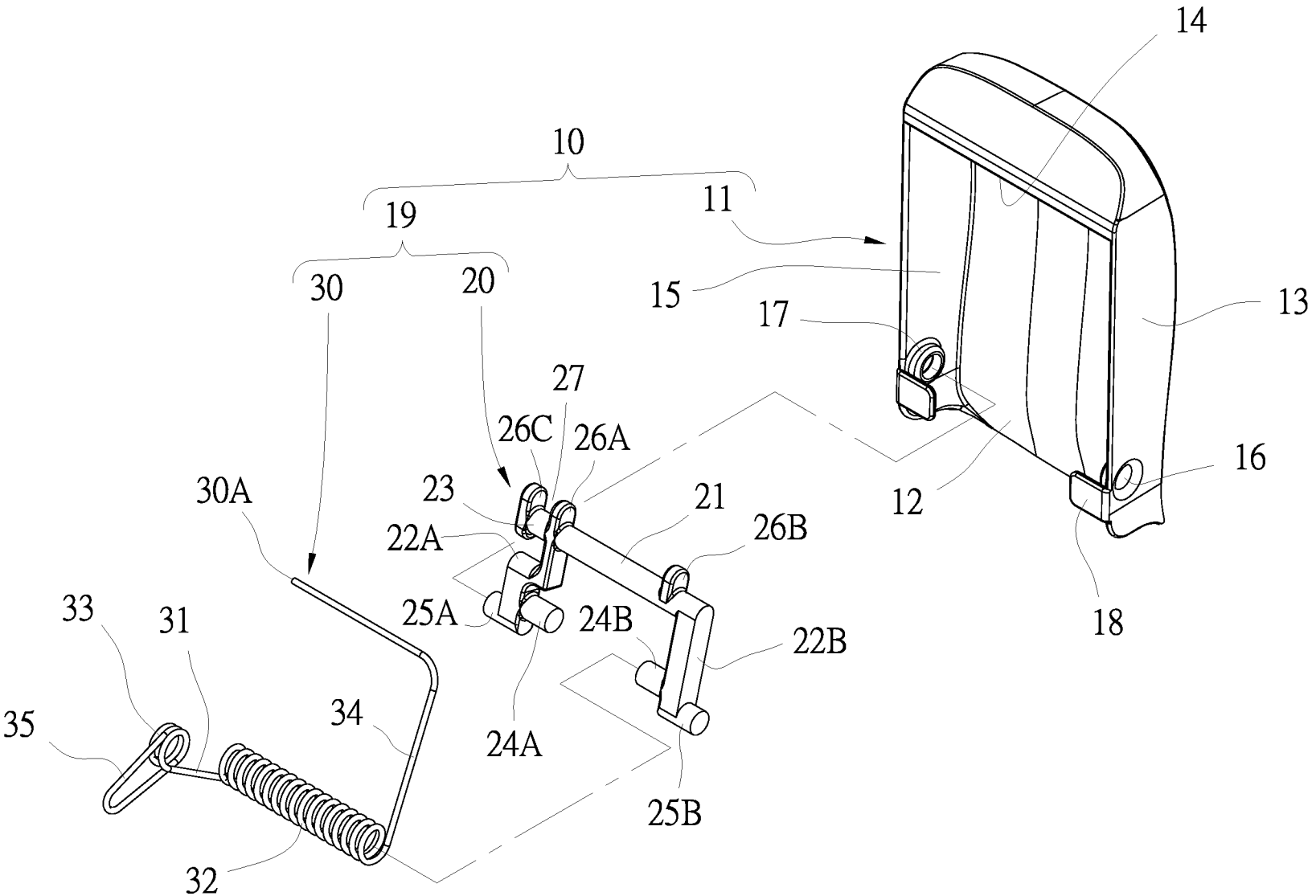
FIG. 1 is an exploded view of a toolbox-locking apparatus according to the preferred embodiment of the present invention.
Figure 3:
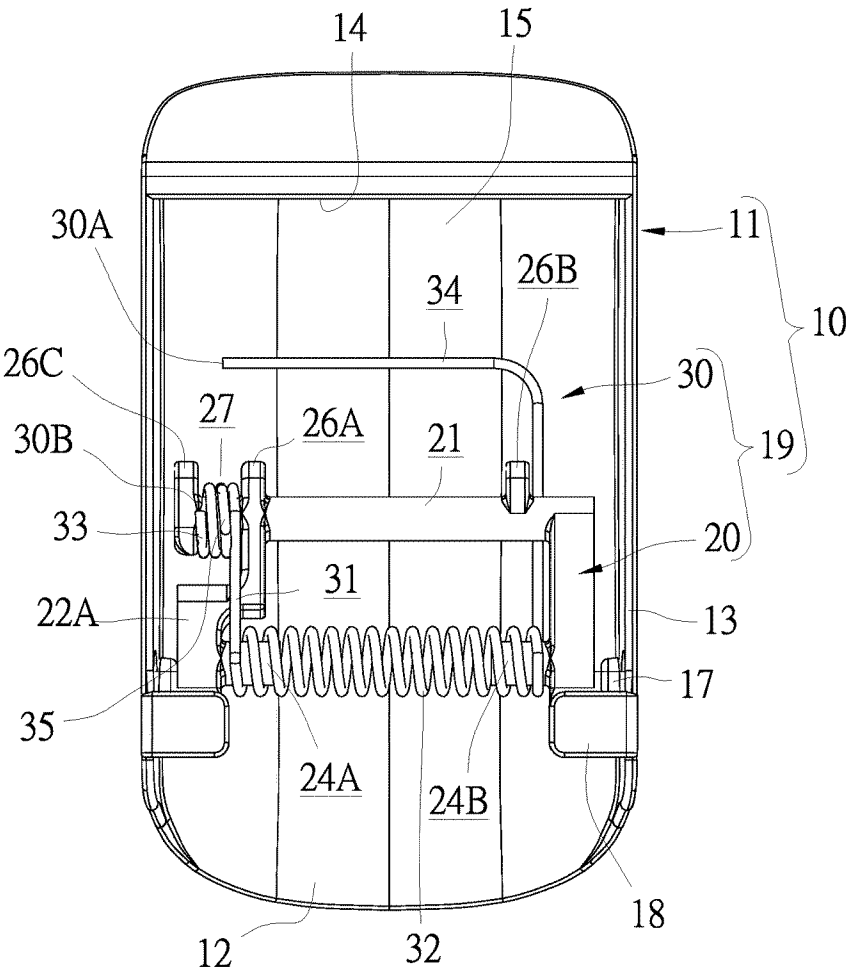
FIG. 3 is a front view of the toolbox-locking apparatus shown in FIG. 2.
Figure 2:
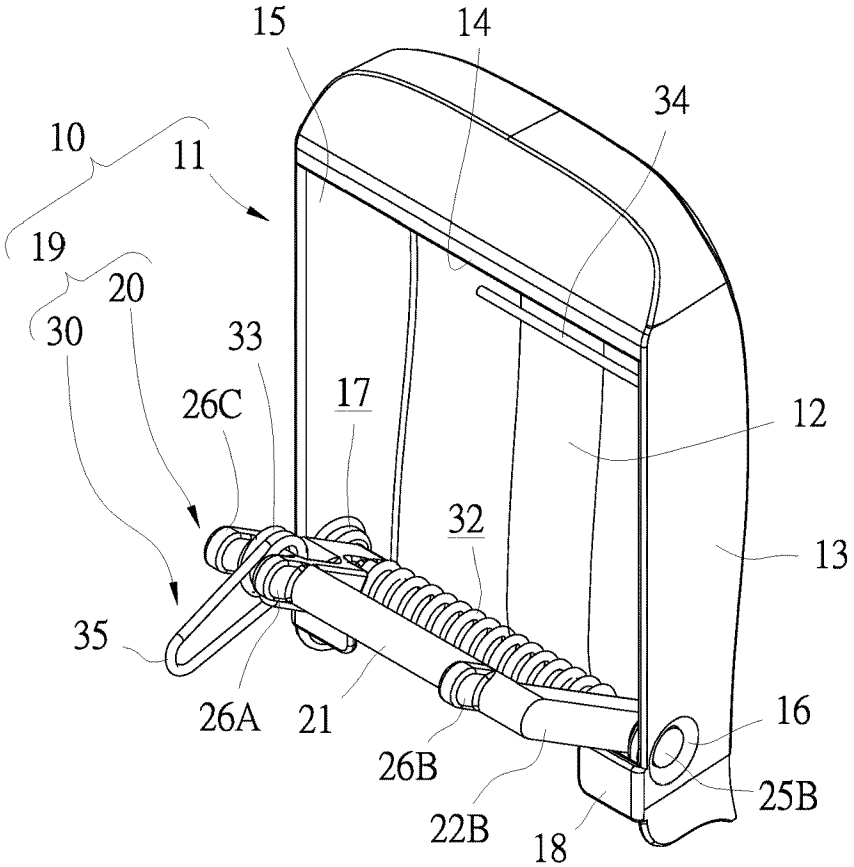
FIG. 2 is a perspective view of the toolbox-locking apparatus shown in FIG. 1.

Referring to FIGS. 1 through 3, a toolbox-locking apparatus 10 includes a buckle 11 and a driving unit 19 according to the preferred embodiment of the present invention. The tool-locking apparatus 10 is used for a toolbox 40 partially shown in FIGS. 4 and 5

The buckle 11 includes a flat body 12, two lateral walls 13 and a hooking wall 14. The flat body 12, the lateral walls 13 and the hooking wall 14 are made in one piece. Each of the lateral walls 13 extends along two lateral edges of the flat body 12. The hooking wall 14 extends along an upper edge of the flat body 12. The flat body 12, the lateral walls 13 and the hooking wall 14 together make a space 15 for receiving the driving unit 19.

The buckle 11 further includes two apertures 16, two limiting portions 17 and two stops 18. Each of the apertures 16 is made in a corresponding one of the lateral walls 13. Each of the limiting portions 17 is an annular portion formed on an internal face of a corresponding one of the lateral walls 13. Each of the limiting portions 17 extends around a corresponding one of the apertures 16. The limiting portions 17 are separated from each other by the space 15. The limiting portions 17 share a common axis. Each of the stops 18 extends transversely from a corresponding one of the lateral walls 13 so that the stops 18 extend toward each other from the lateral walls 13.

The driving unit 19 includes a pivotal element 20 and a torque spring 30. The pivotal element 20 is pivotally connected to the buckle 11. The torque spring 30 is connected to the pivotal element 20 and arranged between the pivotal element 20 and the buckle 11 to pivot the pivotal element 20 relative to the buckle 11.

The pivotal element 20 includes a rod 21, a axle 23, two cranks 22A and 22B, two axles 24A and 24B, two pivots 25A and 25B and three cams 26A, 26B and 26C. The rod 21, the axle 23, the cranks 22A and 22B, the axles 24A and 24B, the pivots 25A and 25B and the cams 26A, 26B and 26C are made in one piece.

The rod 21 and the axle 23 are co-axial with each other. The cams 26A, 26B and 26C are formed on the rod 21 and the axle 23. The rod 21 extends between the cams 26B and 26A. The axle 23 extends between the cam 26A and the cams 26C, with a gap 27 made between the cams 26A and 26C.

The first crank 22A is made with a bent configuration. The first crank 22A includes an intermediate section extending transversely between two lateral sections. The first terminal section of the first crank 22A is connected to an end of the cam 26A. The axle 24A extends from an internal face of the second terminal section of the first crank 22A. The axle 24B extends from an internal face of the second crank 22B. The axle 24A is separated from the axle 24B. The pivot 25A extends from an external face of the second terminal section of the first crank 22A. The pivot 25B extends from an external face of the second crank 22B. Each of the pivots 25A and 25B is inserted in a corresponding one of the apertures 16, thereby pivotally connecting the first and second cranks 22A and 22B to the lateral walls 13 and rendering the pivotal element 20 pivotal relative to the buckle 11. The first crank 22A is separated from the second crank 22B by a gap (not numbered). There is a gap between the limiting portions 17. The difference between the gaps is small to minimize allowed translation of the pivotal element 20 relative to the buckle 11.

The torque spring 30 is formed with an intermediate section 31, two helical sections 32 and 33, two pivotal sections 34 and 35. The intermediate section 31, the helical section 32, the helical section 33, the pivotal section 34 and the pivotal section 35 are made in one piece. The intermediate section 31 extends between the helical section 32 and the helical section 33. The helical section 32 extends about an axis. The helical section 33 extends about another axis. The axes extend parallel to each other and perpendicular to a length of the intermediate section 31. The pivotal section 34 extends from the helical section 32. Preferably, there is an abutting section (not numbered) transversely extending from the pivotal section 34. A free end of the abutting section is referred to as a first end 30A of the torque spring 30. In another embodiment without the abutting section, a free end of the pivotal section 34 will be referred to as the first end 30A of the torque spring 30. The pivotal section 34 and the intermediate section 31 look like a "V" when observed in an axial sense of direction of the helical section 32. A free end of the helical section 33 will be referred to as a second end 30B of the torque spring 30. The pivotal section 35 extends in or from the helical section 33.

The helical section 33 is located on and around the axle 23. The helical section 33 is kept in the gap 27, which is made between the cams 26A and 26C. The helical section 32 is located on and around the axles 24A and 24B. The abutting section, which extends from the pivotal section 34, is in contact with the flat body 12. The helical section 32 exerts torque on the axle 23 via the intermediate section 31 and the helical section 33, thereby pivoting the rod 21, the first crank 22A and the second crank 22B about the pivots 25A and 25B. Now, the stops 18 stop the first crank 22A and the second crank 22B to render the pivotal of the pivotal element 20 from the buckle 11 in a proper range.

Figure 4:
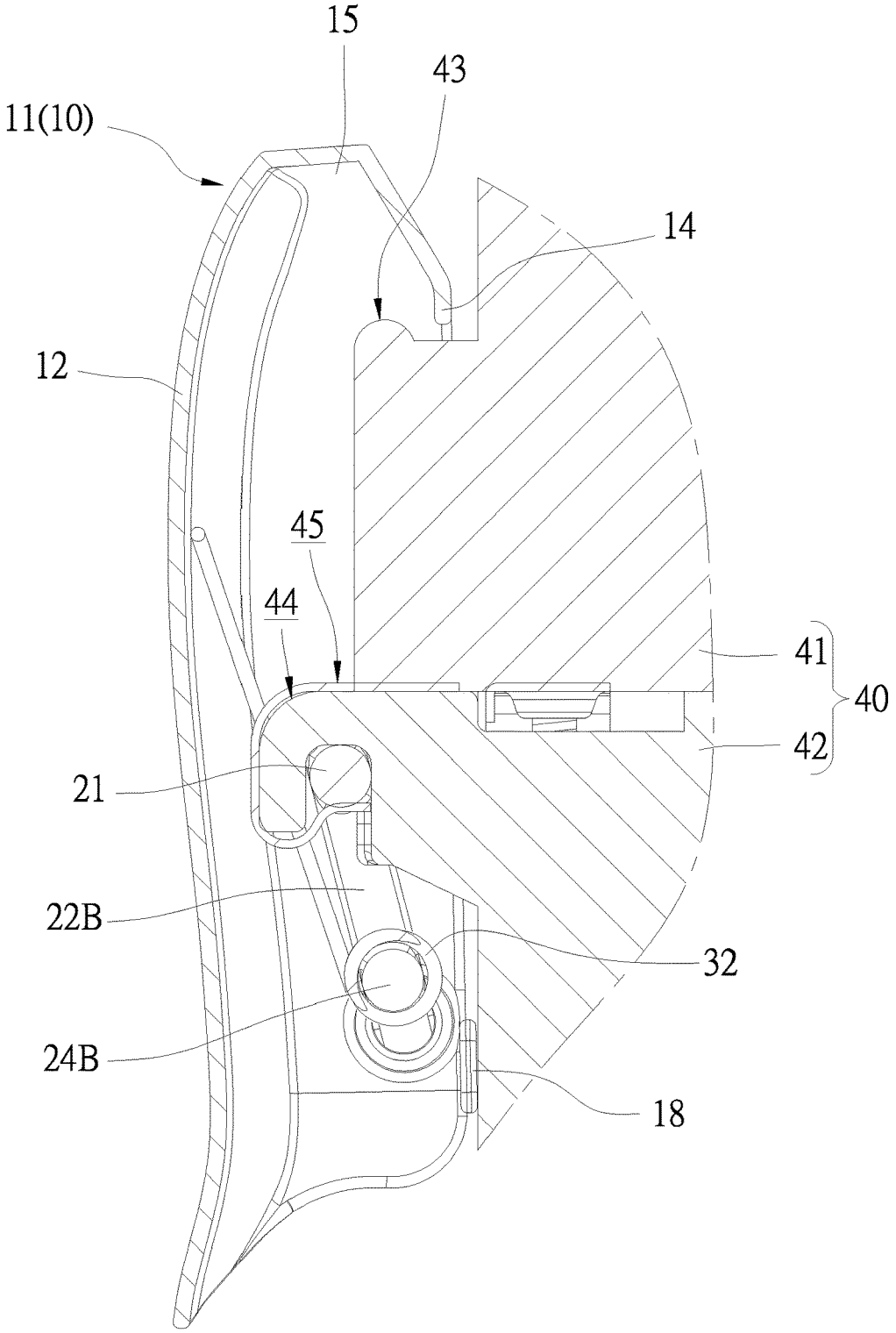
FIG. 4 is a cross-sectional view of the toolbox-locking apparatus shown in FIG. 2.
Figure 5:
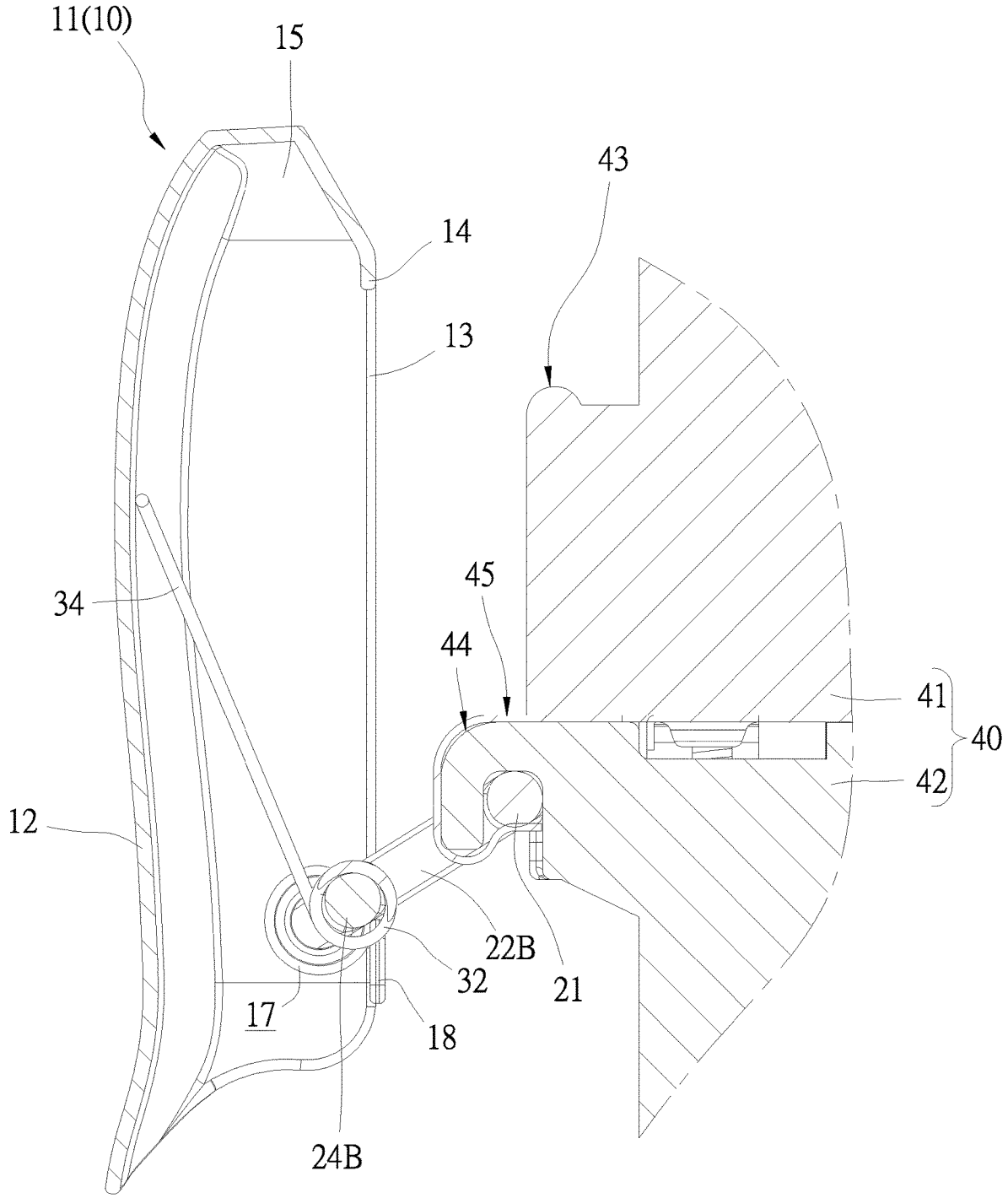
FIG. 5 is a cross-sectional view of the toolbox-locking apparatus in another position than shown in FIG. 4.

Referring to FIGS. 4 and 5, the toolbox-locking apparatus 10 is used for and connected to the toolbox 40. The toolbox 40 includes a first shell 41, a second shell 42, a buckle-engaging element 43, a supporting element 44 and a restraining element 45. The first shell 41, the second shell 42, the buckle-engaging element 43 and the supporting element 44 are made in one piece. The first shell 41 is pivotally connected to the second shell 42 so that the toolbox 40 is movable between an open position and a closed position. The buckle-engaging element 43 is formed on an internal face of the first shell 41. The supporting element 44 is in the form of a hook extending from an external face of the second shell 42. The supporting element 44 includes a portion in contact with a portion of the buckle-engaging element 43 when the toolbox 40 is in the closed position.

The rod 21 is inserted in a space (not numbered) made by the supporting element 44. Preferably, the restraining element 45 is a strip connected to the second shell 42. The restraining element 45 closes the space made by the supporting element 44, thereby keeping the rod 21 in the space made by the supporting element 44 while allowing the rod 21 to rotate relative to the supporting element 44. Of course, the restraining element 45 keeps the pivotal section 35 and the cams 26A, 26B and 26C on the second shell 42, without interfering with the operation of the toolbox-locking apparatus 10. Details of the operation of the toolbox-locking apparatus 10 can be found in Taiwanese Patent No. M542550.

Referring to FIG. 4, in the closed position, the first shell 41 is placed against the second shell 42, with the buckle-engaging element 43 laid on the supporting element 44. Now, the buckle 11 is located close to the toolbox 40 so that the buckle-engaging element 43 and the supporting element 44 are partially inserted in the space 15 of the buckle 11. Moreover, the pivotal section 34 is squeezed and deformed by the flat body 12, thereby twisting the helical section 32. The hooking wall 14 is placed over the buckle-engaging element 43, and pulled down by the second crank 22B (or the first crank 22A). Hence, the hooking wall 14 is engaged with the buckle-engaging element 43, keeping the first shell 41 against the second shell 42, i.e., keeping the toolbox 40 closed.

Referring to FIG. 5, in the open position, the hooking wall 14 is moved upward and disengaged from the buckle-engaging element 43 by the second crank 22B. Finally, the second crank 22B is stopped by the stops 18. Now, the buckle-engaging element 43 is disengaged from the buckle 11, allowing the first shell 41 to be pivoted from the second shell 42, i.e., allowing the toolbox 40 to be opened.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A toolbox-locking apparatus comprising:

a buckle comprising a space and a driving unit inserted in the space, wherein the driving unit comprises a pivotal element pivotally connected to the buckle and a torque spring supported on the pivotal element, and adapted for biasing the pivotal element relative to the buckle, and the pivotal element comprises:

a rod;

primary axle extending coaxially from the rod;

two cams formed on the primary axle and separated from each other by a gap; and two cranks extending from the rod; and two secondary axles respectively extending from the cranks; and the torque spring comprises a first helical section supported on the primary axle and kept in the gap between the cams, a second helical section supported on the secondary axles, a first pivotal section extending from the first helical section and abutting against a toolbox, and a second pivotal section extending from the second helical section and abutting against the buckle.

2. The toolbox-locking apparatus according to claim 1, wherein the buckle comprises a flat body and two lateral walls extending from the flat body to define the space, wherein the cranks are pivotally connected to the lateral walls.

3. The toolbox-locking apparatus according to claim 2, wherein the buckle comprises two stops extending toward each other from the lateral walls, wherein the stops are adapted for stopping the cranks, thereby keeping the pivoting of the cranks relative to the buckle in a proper range.

4. The toolbox-locking apparatus according to claim 2, wherein each of the lateral walls is made with an aperture, wherein the pivotal element comprises two pivots extending from the cranks in a corresponding one of the apertures, thereby pivotally connecting the pivotal element to the buckle.

5. The toolbox-locking apparatus according to claim 4, wherein each of the lateral walls comprises two limiting portions extending around the aperture thereof.

* * * * *